United States Patent [19]

Bailey

[11] Patent Number: 4,876,138

[45] Date of Patent: Oct. 24, 1989

[54] SYNTHETIC LEATHER-LIKE MATERIAL

[76] Inventor: Linda F. Bailey, Doug Hill Rd., Island, Ky. 42350

[21] Appl. No.: 162,810

[22] Filed: Mar. 1, 1988

[51] Int. Cl.[4] ..... B32B 27/02; B32B 27/08; B32B 00/12; B32B 00/30

[52] U.S. Cl. ..... 428/172; 427/381; 427/384; 427/387; 427/389.9; 427/394; 427/412; 428/151; 428/246; 428/252; 428/447; 428/451; 428/515; 428/520; 428/904

[58] Field of Search ..... 428/151, 172, 246, 252, 428/447, 451, 515, 520, 904; 427/412, 381, 384, 387, 389.9, 394

[56] References Cited

U.S. PATENT DOCUMENTS

| | | | |
|---|---|---|---|
| 3,434,875 | 3/1969 | Smith et al. | 117/139.4 |
| 3,616,005 | 10/1971 | Wetstone | 156/183 |
| 3,985,929 | 10/1976 | von Bonin | 428/290 |
| 4,181,769 | 1/1980 | Plamondon | 428/253 |

*Primary Examiner*—Marion C. McCamish
*Attorney, Agent, or Firm*—Middleton & Reutlinger

[57] ABSTRACT

A synthetic leather-like material includes a woven fabric base, an acrylic paint layer over the fabric, a clear polymer layer over the paint, and a silicone layer over the polymer.

8 Claims, 1 Drawing Sheet

SYNTHETIC LEATHER-LIKE MATERIAL

BACKGROUND OF THE INVENTION

Many different methods have been used in the past to create synthetic leathers for use in upholstery fabric, for making shoes, and so forth. Each type of synthetic leather has different properties, depending on the purpose for which the material is to be used. For example, material for shoes must be durable, upholstery fabric must be flexible, and so forth.

The synthetic material of the present invention was developed primarily for its artistic properties - its look and feel. It has been used for making stuffed animals and other formed shapes, and, by varying the method of manufacture slightly, it may have the look of new or aged leather.

One of the advantages of the present invention is that it is simple enough to be applied by an individual artist so that it can be applied to a shape the artist has formed and can be varied slightly for different visual effects and textures.

DESCRIPTION OF THE PREFERRED EMBODIMENTS

Figure 1:
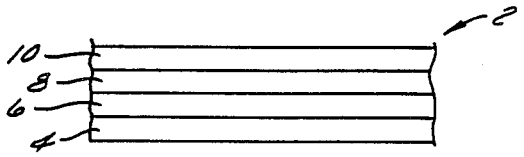
FIG. 1 is a schematic side view of a synthetic material made in accordance with the present invention.

FIG. 1 shows the simplest embodiment of the present invention, which is made up of four layers. The synthetic material 2 is made up of a base 4, which is a woven fabric, with additional layers 6, 8, 10 applied to the base 4. A preferred woven fabric base 4 is muslin, but many other fabrics have been used successfully, such as 100% nylon, ribbon, chintz (a combination fiber), 100% cotton, and artist canvas.

The base fabric 4 may be treated in its flat, unformed state or may first be formed into a shape, such as being sewn and stuffed to make a stuffed animal, and then treated. If the fabric 4 is treated before forming, the user of the fabric is then somewhat limited in the shapes which may be formed, because the treated fabric is less flexible than the untreated fabric.

The second layer 6 of this synthetic material is an acrylic latex paint, such as that manufactured by Porter Paint Co., Louisville, Ky. 40201, U.S.A., and sold as acrylic eggshell enamel, an interior enamel for trim. Other acrylic paints could also be used. The paint may be applied in any known manner, such as with a brush or roller.

The amount of drying time allowed for the paint layer 6 affects the look of the finished product. If it is not allowed to dry completely before taking the next step, a smeared effect of different color ranges of the same base coat color will be seen. If allowed to completely dry, no smearing has been seen.

It is possible to apply successive coats of acrylic paint to make a thick paint layer 6. If the paint in successive coats is of different colors, the visual effect will again be different. Alternatively, different colors of paint may be applied side-by-side on the fabric base 4 to form a multicolored paint layer 6.

The next layer, which is indicated as layer 8, is a clear polymer latex emulsion, which again is applied in any known manner, such as with a brush. The particular emulsion that has been used successfully is Mod Podge ® matte-mat manufactured by Plaid Enterprises, Inc., P.O. Box 7600, Norcross, Ga. 30091, U.S.A. It is understood from U.S. Pat. No. 3,616,005 "Wetstone", which is hereby incorporated by reference, that the preferred material for use in this polymer layer 8 comprises about 92.5% by weight of an approximately 55% nonvolatile polyvinyl acetate aqueous latex including conventional stabilizers with about 7.5% of dibutyl phthalate or other conventional plasticizers. The polymer layer 8 may be applied as a thin coat or as a heavy coat, wiping off the excess with a towel. More than one coat of this polymer layer 8 may be applied if drying time is allowed between applications.

The next layer 10 is a layer of silicone, which is preferably applied as a silicone spray onto the surface of the polymer layer 8 and is rubbed lightly to ensure even coverage over the material. The silicone layer 10 enhances the feel of the material and decreases the tendency of the material to adhere to itself.

Figure 2:
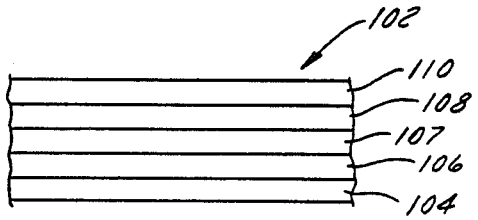
FIG. 2 is a schematic side view of a second embodiment of a material made in accordance with the present invention.

Another embodiment of the invention is shown in FIG. 2. In this embodiment, the material 102 again includes a woven fabric base 104 with a coat of acrylic paint 106 on top of it. The next layer 107 is a water base acrylic stain, such as Delta Ceramcoat ® Aqua Stain ® water base acrylic wood stain, a product of the Slomons Group, Newark, N.J. 07102, U.S.A. The application of the stain layer 107 gives the material 102 an aged look. The stain 107 is applied in any known manner, such as with a brush. The excess is wiped off, and then the stain 107 is allowed to dry. Different colors of stain 107, such as maple, walnut, and so forth, allow for different color effects on the finished product. Also, diluting the stain with water can result in different visual effects of the finished product. The amount of time the stain 107 is allowed to remain on the surface of the paint layer 106 will allow for different visual effects, as the stain layer 107 will cut into the paint layer 106 to some extent. The excess stain 107 preferably is wiped off with a rough textured paper towel, which smooths the surface of the paint 106 and gives a better finish and feel to the end product. It is possible to leave excess stain in certain areas of the material for an aged look. For example, in a soft sculptured item, the full strength stain may be left unwiped in the indentations and crevices to give an aged look to the sculpture. When the stain layer 107 has dried, the polymer layer 108 is applied onto the stain layer 107 in the same manner as described in the previous embodiment, and, when the polymer layer 108 has dried, the silicone layer 110 is applied. Again, this embodiment shows a polymer layer 108 above the paint layer 106.

Figure 3:
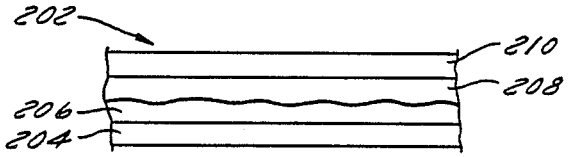
FIG. 3 is a schematic side view of a third embodiment of a material made in accordance with the present invention.

Another alternative embodiment is shown in FIG. 3. In this embodiment, the material 202 again has a woven fabric base 204 with an acrylic paint layer 206 on top of the base 204. Then, water is applied on top of the acrylic paint layer 206. The excess water is wiped off, and then the paint layer 206 is again allowed to dry. This creates a newer look to the material 202. Then, as in the earlier embodiments, the polymer layer 208 is applied and allowed to dry, and then the silicone layer 210 is applied. The effect of applying the water onto the acrylic paint layer 206, is to cut into the paint layer 206, to smooth it out or to roughen it. In FIG. 3, the paint layer 206 has been roughened by application of the water, so that the thickness of the acrylic paint layer 206 can vary across the material 202 and may even be removed entirely at some points.

Figure 4:
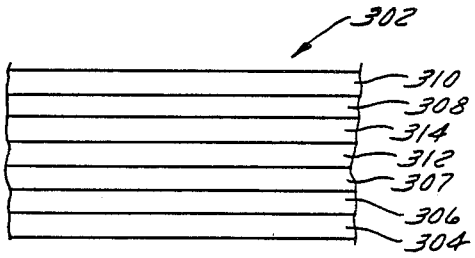
FIG. 4 is a schematic side view of a fourth embodiment of a material made in accordance with the present invention.

Another embodiment of the invention, shown in FIG. 4, includes additional layers. The material 302 has a woven fabric base 304, an acrylic paint layer 306, and a stain layer 307. On top of the stain layer 307 is an additional layer of acrylic paint 312 and an additional layer of stain 314. On top of the uppermost stain layer 314 is the polymer layer 308 and the silicone layer 310. This arrangement forms a heavier material then the previous arrangements, due to the extra layers.

It will be understood that variations and modifications may be made to the embodiments described above without departing from the scope of the present invention.

What is claimed is:

1. A synthetic leather-like material, comprising:

A. a woven fabric base;

B. an acrylic paint layer in contact with the fabric base;

C. a clear polymer layer over the paint layer; and

D. a silicone layer over the clear polymer layer.

2. A synthetic leather-like material as recited in claim 1, and further comprising:

an acrylic base stain layer over the acrylic paint layer and under the clear polymer layer.

3. A synthetic leather-like material as recited in claim 1, wherein the thickness of the acrylic paint layer varies across the material.

4. A synthetic leather-like material as recited in claim 1, wherein the clear polymer layer is a polyvinyl acetate.

5. A process for producing a leather-like material, comprising the steps of:

A. applying acrylic paint to a woven fabric; then

B. applying a clear polymer latex emulsion in a layer above the paint layer; then C. applying a layer of silicone above the clear polymer layer.

6. A process for producing a leather-like material as recited in claim 5, and further comprising the step of:

applying a water base acrylic stain onto the acrylic paint layer before applying the clear polymer latex emulsion.

7. A process for producing a leather-like material as recited in claim 5, and further comprising the step of:

applying water onto the acrylic paint layer and wiping off the excess water before applying the clear polymer latex emulsion layer.

8. A process for producing a leather-like material as recited in claim 5, wherein the clear polymer latex emulsion comprises a nonvolatile polyvinyl acetate aqueous latex including stabilizers and plasticizers.

* * * * *